United States Patent [19]

Wylde

[11] 4,274,232

[45] Jun. 23, 1981

[54] FRICTION GRIP PAD

[75] Inventor: Stephen J. Wylde, Croydon, England

[73] Assignee: Minnesota Mining and Manufacturing Company, Saint Paul, Minn.

[21] Appl. No.: 922,785

[22] Filed: Jul. 7, 1978

[30] Foreign Application Priority Data

Sep. 14, 1977 [GB] United Kingdom ..... 38352/77
Oct. 7, 1977 [GB] United Kingdom ..... 41810/77

[51] Int. Cl.[3] ..... B24B 13/02; B24D 17/00

[52] U.S. Cl. ..... 51/358; 51/406; 51/DIG. 34

[58] Field of Search ..... 51/105 LG, 106 LG, 124 L, 51/DIG. 34, 358, 401–407

[56] References Cited

U.S. PATENT DOCUMENTS

| | | | |
|---|---|---|---|
| 2,286,208 | 6/1942 | Kirchner | 51/DIG. 34 |
| 2,732,065 | 1/1956 | Marchese | 51/406 |
| 3,144,737 | 8/1964 | Faas | 51/406 |
| 3,225,497 | 12/1965 | Brandt | 51/358 |
| 3,583,111 | 6/1971 | Volk | 51/358 |
| 3,959,935 | 6/1976 | Stoppacher | 51/DIG. 34 |

*Primary Examiner*—Harold D. Whitehead
*Assistant Examiner*—K. Bradford Adolphson
*Attorney, Agent, or Firm*—Cruzan Alexander; Donald M. Sell; Richard Francis

[57] ABSTRACT

For application to the working surface of a tool for grinding, lapping or polishing optical lenses; a base pad comprising a flexible carrier layer, an adhesive film on one side of the carrier layer by which the pad can be adhered to the working surface of the tool, and a friction-grip surface on the other side of the carrier layer adapted to frictionally grip the lower surface of a lens-working pad applied to it whereby the use of an adhesive between the two pads is avoided.

6 Claims, 12 Drawing Figures

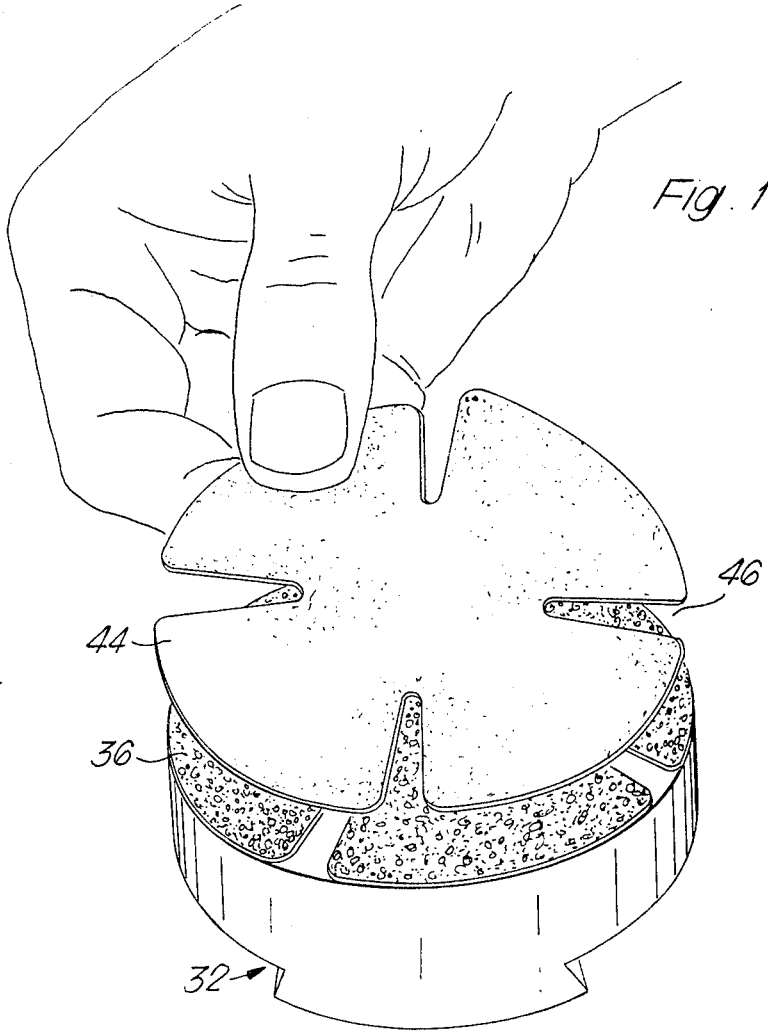
Fig. 11.
Fig. 12.
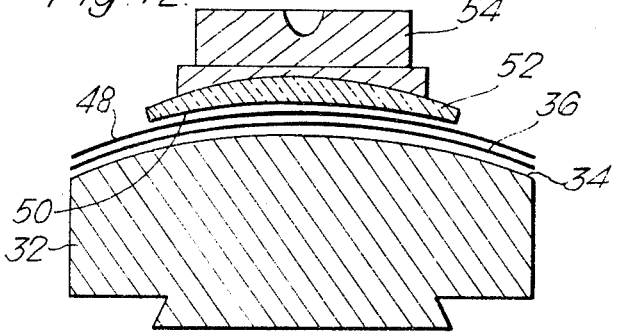

FRICTION GRIP PAD

BACKGROUND OF THE INVENTION

1. Field of the Invention

This invention relates to a pad for frictionally gripping lapping foils and polishing pads during the grinding, lapping and polishing of optical lenses made either of glass or transparent synthetic plastics material.

2. The Prior Art

Optical lenses are generally ground, lapped or polished by means of a tool having a carefully machined surface which conforms to that desired on one face of an optical lens. Sometimes the same tool has two such surfaces—one for shaping one side of the lens and the other for shaping the other side of the lens, or else one for producing an approximate surface on the lens and the other for producing an accurate surface on the lens. Usually the working surface or surfaces on these tools are of convex or concave shape.

In order to reduce the rate of wear on the said working surfaces of these tools, it is usual to apply to them an adhesive-backed replaceable pad which is sufficiently thin to be brought into conformity with the convex or concave working surface of the tool. Various forms of pad have been proposed in the past, including aluminium pads, steel pads and pads made of perforated metal so that slurry can be retained in the perforations.

SUMMARY OF THE INVENTION

The present invention constitutes a departure from this practice in that a base pad is first applied to the working surface of the tool, after which a lapping foil or polishing pad is applied to the upper surface of the base pad without the use of an adhesive between the two pads.

Essentially, a base pad according to the invention comprises a flexible carrier layer having an adhesive on one side by which the pad can be adhered to a working surface of a tool and having, on its other side, a friction-grip surface adapted to so frictionally grip the lower surface of a lapping foil or polishing pad that the use of an adhesive between the two pads is avoided.

The base pad can be made of various materials. In one form, the flexible carrier layer is "wet-or-dry" paper with a friction-grip surface composed of silicon carbide abrasive particles having a mesh size of P 600 in the European Standard of Grain Classification. In another form of base pad, the flexible carrier layer is a soft aluminium foil having a friction-grip surface composed of a layer of synthetic resin or other binder material in which are distributed small grains of a hard mineral material, the resin binder preferably being an epoxy resin while the mineral comprises grains of calcined bauxite (aluminium oxide).

In order that the base pad may conform precisely to the convex or concave working surface of a tool, it will generally have slots cut in from its peripheral edge in accordance with established practice in the lens grinding and polishing industry.

The invention also extends to an assembly comprising a grinding, lapping or polishing tool having a base pad of the construction described above adhered to its working surface, there being a lapping foil or polishing pad laid on and conforming to the upper surface of the base pad which grips the said lapping foil or polishing pad by means of friction only.

BRIEF DESCRIPTION OF THE DRAWINGS

Some examples of friction-grip base pads in accordance with the invention as well as illustrations of the way in which they are used are shown in the accompanying drawings, in which:

FIG. 11 is a perspective view similar to FIG. 8 showing a soft polishing pad about to be applied to the base pad shown in FIG. 6; and FIG. 12 is a vertical section through a tool assembly during the actual grinding, lapping or polishing of an optical lens.

DETAILED DESCRIPTION OF THE PREFERRED EMBODIMENTS

Figure 1:
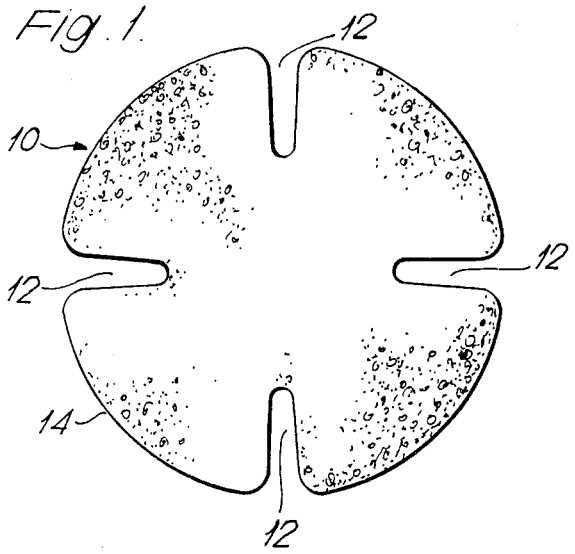
FIG. 1 is a plan view of one form of base pad.

The base pad 10 shown in FIG. 1 is of generally circular shape and has four equi-spaced radial slots 12 cut into it from the outer peripheral edge 14 of the pad. These slots are quite usual in lens grinding, lapping and polishing pads and assist in bringing the pad into conformity with the convex or concave working surface of a lens grinding, lapping or polishing tool.

Figure 2:
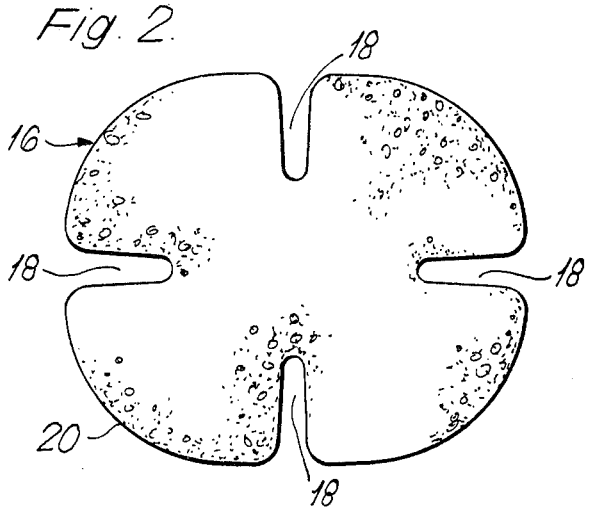
FIG. 2 is a plan view of a second form of base pad.

The pad 16 shown in FIG. 2 is similar to that shown in FIG. 1 except that it is more elliptical in shape—which is the shape frequently favoured in the United States of America. Four equi-spaced radial slots 18 are formed in the pad, the slots entering the latter from the peripheral edge 20 of the pad.

Figure 3:
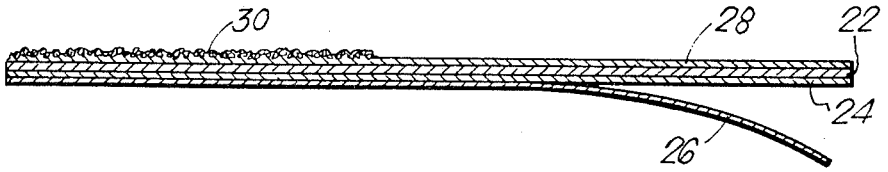
FIG. 3 is an enlarged section through either one of the two pads shown in FIGS. 1 and 2.

As shown in FIG. 3, each of the two pads shown in FIGS. 1 and 2 comprises a flexible carrier layer 22 of soft aluminium or some other soft metal. The lower surface of this layer has an adhesive layer 24 applied to it during manufacture of the pad for the purpose of attaching the pad to the working surface of the tool once a protective layer 26 of paper, synthetic plastics material or metal foil has been peeled off prior to use of the pad.

The upper face of the carrier layer 22 has a layer 28 of a synthetic resin material applied to it, the preferred resin being an epoxide resin. Embedded in this resin, which therefore acts as a binder, are grains 30 of a mineral material such as calcined bauxite (aluminium oxide) which provide a friction-grip upper surface for the pad. As will be understood, the grains 30 are distributed in the layer 28 of resin after the latter has been applied in liquid form to the carrier layer 22. Then, when the resin sets, the grains of mineral material will be firmly held or "bound" by the resin. Preferably the grains 30 of mineral material have a size in the range of P 120 to P 60 (European Standard of Grain Classification), the best size having been found to be in the region of P 80. Besides bauxite, the grains could also be made equally well of silicone carbide.

Figure 4:
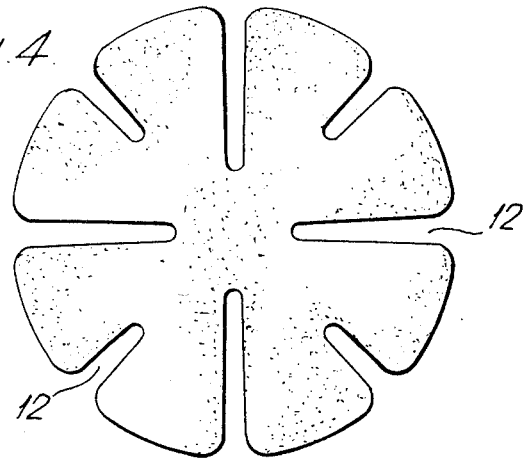
FIGS. 4 and 5 are plan views of two further forms of base pad.
Figure 5:
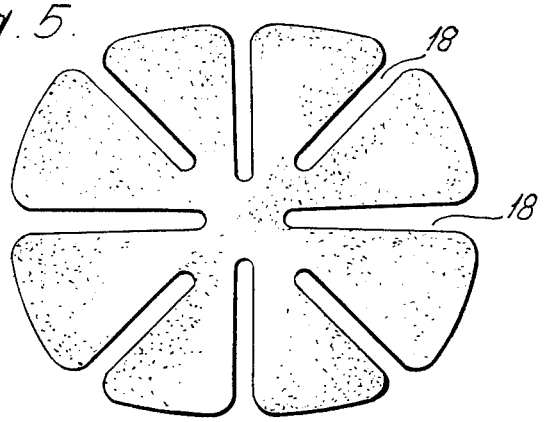

FIGS. 4 and 5 show two further forms of base pad. Each of these has a flexible carrier layer of "wet-or-dry" paper with a friction-grip upper surface composed of silicon carbide abrasive particles having a mesh size of P 600 in the European Standard of Grain Classification. Like the base pads shown in FIGS. 1–3, the pads of FIGS. 4 and 5 each have an adhesive layer on their under surfaces, the adhesive layer being applied during manufacture of the pad and being protected prior to use of the pad by a layer of paper which can be peeled off.

The pad shown in FIG. 4 is of circular shape, while that shown in FIG. 5 is generally elliptical. Slots 12, 18 are formed in the pads as in the pads shown in FIGS. 1 and 2.

Figure 6:
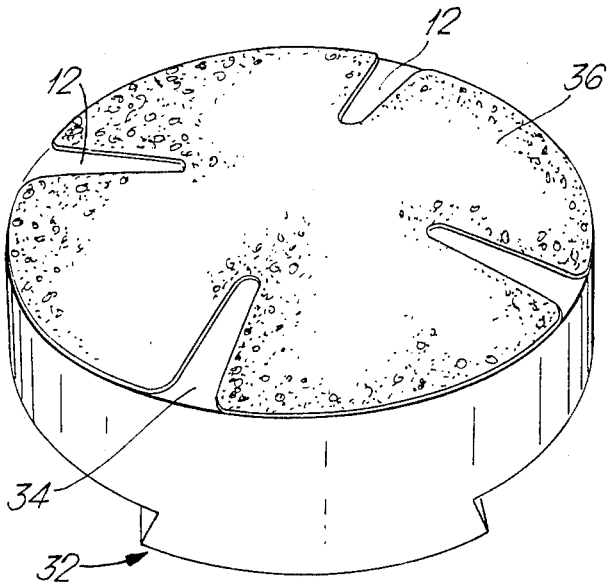
FIG. 6 is a perspective view of an optical tool having a base pad of the construction shown in FIG. 1 adhered to its convex working surface.

FIG. 6 shows a typical metal tool 32 used to grind, lap or polish optical lenses. The tool is cylindrical and has an upper working surface 34 of convex shape. It is to be understood however that the tool could equally well have an upper working surface of concave shape.

Applied to the working surface 34 of the tool is a friction-grip base pad 36 of the construction shown in FIG. 1, although the base pad could equally well be that shown in FIG. 4. In other words, the protective layer 26 shown in FIG. 3 has been peeled off the pad so that the adhesive layer 24 on the underside of the pad serves to bond the latter to the surface 34 of the tool. The slots 12 in the pad assist in bringing the latter into close conformity with the convex surface 34.

The rough upper surface of the pad 36 does not make contact with a lens directly. On the contrary, it serves to frictionally grip the lower surface of a lapping foil or polishing pad applied to it. Thus, FIG. 8 shows an expanded zinc foil 38 of the construction shown in FIG. 7 being applied to the upper surface of the pad 36 and about to be pressed down so that it takes up the convex contour of the pad 36 and the tool working surface 34. There is no adhesive on the under surface of the expanded zinc foil 38 as it will be gripped frictionally by the rough upper surface of the pad 36. As will be understood, the slots 40 in the expanded zinc foil 38 permit the foil to take up the convex shape of the tool.

Figure 7:
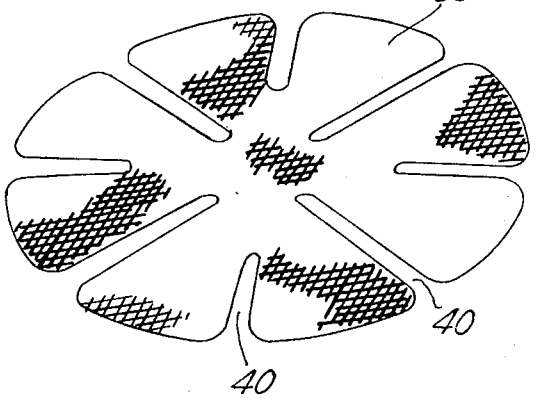
FIG. 7 is a perspective view of a typical lapping foil of expanded zinc.
Figure 9:
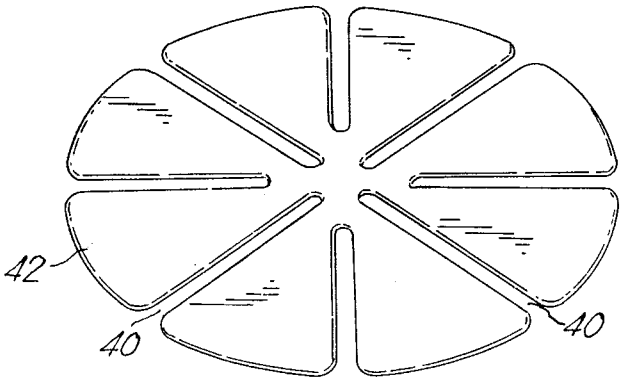
FIG. 9 is a perspective view similar to FIG. 7 of a lapping foil of soft unperforated aluminium which can likewise be laid on the upper surface of the base pad shown in FIG. 6.
Figure 8:
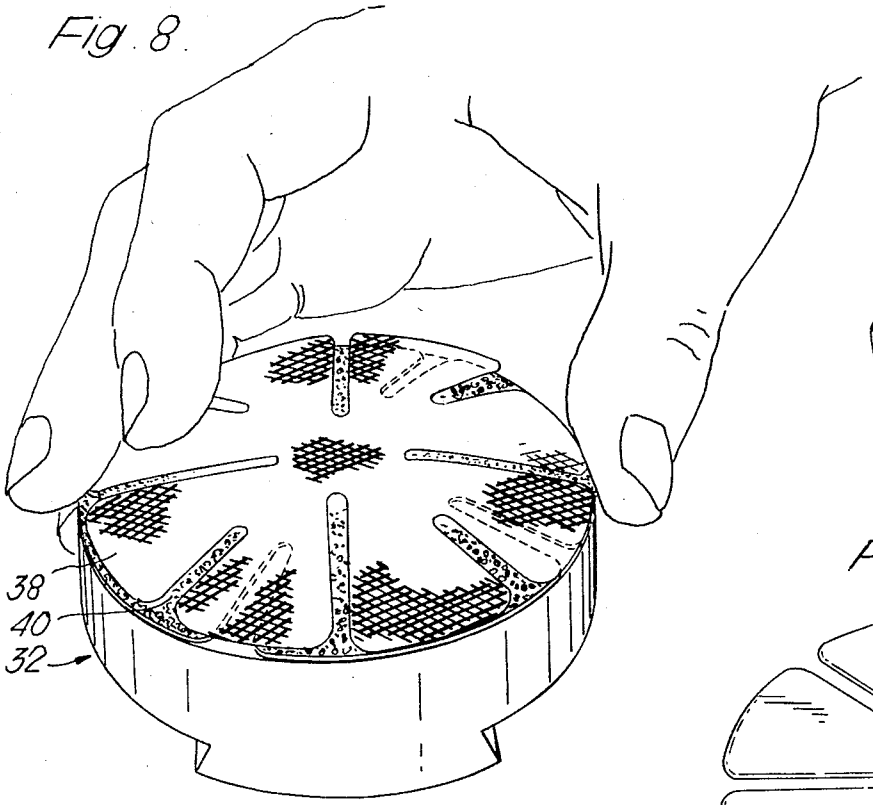
FIG. 8 is a view of the tool and base pad shown in FIG. 6 with the expanded zinc foil shown in FIG. 7 laid on top of the base pad.

Other lapping foils can equally well be used in place of the expanded zinc foil shown in FIGS. 7 and 8. For example, the soft unperforated aluminium foil 42 shown in FIG. 9 or the plated diamond foil 43 shown in FIG. 10 can likewise be applied to the upper surface of the pad 36. As with the foil 38 shown in FIG. 7, the foils 42 and 43 each have radial slots 40.

FIG. 11 shows a soft polishing pad 44 being applied to the upper surface of the friction-grip pad 36. As with the expanded zinc foil 38 shown in FIGS. 7 and 8, the polishing pad 44 will be held on the tool by friction gripping alone. In other words, no adhesive is used to attach the lower surface of the polishing pad 44 to the upper surface of the friction-grip pad 36. In order to bring the pad 44 into a convex shape, it has slots 46 in the same way as the pads shown in FIGS. 7, 9 and 10.

FIG. 12 is a section through the tool 32 shown in FIGS. 6, 8 and 11 during the actual grinding, lapping or polishing of an optical lens. As will be seen, the tool 32 has a friction-grip base pad 36 adhered to its upper convex surface 34, and there is a lapping foil or a polishing pad 48 applied to the rough upper surface of the pad 36 so as to be held frictionally by the latter. The foil or pad 48 can be any one of the three foils shown in FIGS. 7, 9 and 10, or the polishing pad shown in FIG. 11.

The pad or foil is thus able to work on the concave undersurface 50 of an optical lens 52 which is removably held by a lens-holding block 54.

According to which form of machine is being used, the tool 32 and/or the lens-holding block 54 have such a movement imparted to them by means not shown in the drawing as to cause relative movement between the lower surface 50 of the lens and the foil or pad 48. As such grinding, lapping or polishing operations are well known in the optical industry, they will not be described further.

Figure 10:
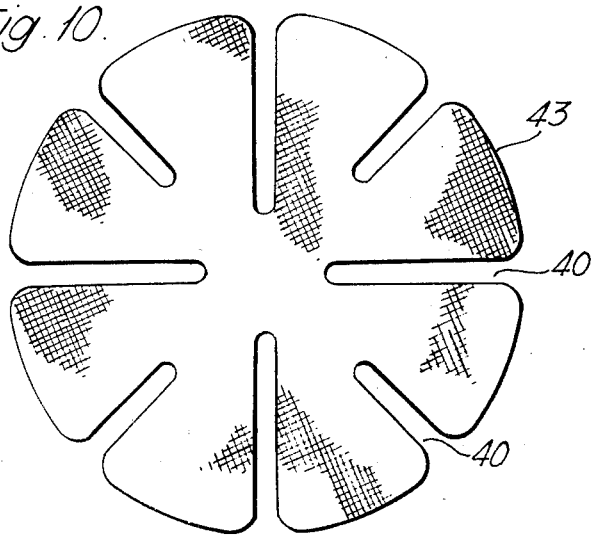
FIG. 10 is a plan view of a plated diamond lapping foil which can also be laid on the base pad shown in FIG. 6.

It will therefore be seen that the friction-grip base pads described above not only save wear on the working surfaces of tools to which they are applied, but they also permit lapping foils or polishing pads to be readily applied to the tool and to be easily removed once they have become worn or have begun to disintegrate. Further, the fact that such lapping foils and polishing pads can now be used without an adhesive on them means that the cost of producing them is reduced and the problem of having to remove dried-up adhesive when a lapping foil or a polishing pad is replaced no longer exists.

Where lapping is carried out using a plated diamond foil as shown in FIG. 10, it has been found that, provided care is taken not to fold or tear the plated diamond foil, it will produce hundreds of good quality synthetic plastics optical lenses if the following instructions are carried out.

Following the lens-generating operation, the first fining uses fresh tap water flowing through a surfacing machine, and the working surface of the tool is covered with an adhesive-backed base pad of the form shown in FIGS. 1 or 4. This pad is used as a friction-grip interfacing over which the plated diamond foil or pad is laid before applying the lens and starting the machine to run for one minute.

Provided that the generating form was correct, the plated diamond foil or pad can now be lifted off the tool to a safe storage place and replaced with a different lapping foil, and the lens lapped for a further two minutes in clean running water. Finally, the lens and tool are placed in a polishing machine, and again the friction of the base pad will hold a polishing pad (see pad 44 in FIG. 11) during the polishing operation.

The tool can then be returned to store with the friction-grip base pad still in position, ready for the next lens, and this can be used for many lenses. The invention therefore provides a labour-saving and material-saving system for producing fine quality lenses.

I claim:

1. A tool for working on the surface of an optical lens comprising a base having a curved working surface, a base pad having an abrasive coated surface composed of a layer of binder material in which is distributed grains of hard mineral material and a mounting surface opposite said abrasive coated surface, adhesive means for bonding said base pad to said curved working surface, and a working pad laid on and conforming to the abrasive coated surface of said base pad, said working pad having a first surface means adapted for working on a lens surface and a second relatively soft surface means, opposite said first surface means, to frictionally engage with said abrasive coated surface, said abrasive coated surface being sufficiently rough to frictionally engage with said second surface means and being the sole means to retain said working pad on said tool while said tool curved surface is being urged against the surface of a lens being worked on.

2. The tool of claim 1 wherein said base pad is adherently bonded to said curved working surface by means of a layer of adhesive on the surface of said base pad opposite said abrasive surface.

3. A tool according to claim 1, in which said base pad includes a flexible carrier layer comprised of wettable paper.

4. A tool according to claim 1, in which said coated abrasive surface is formed of silicon carbide abrasive particles.

5. A tool according to claim 1, in which the base pad includes a flexible carrier layer comprised of soft aluminum foil.

6. A tool according to claim 1, wherein said base pad has slots cut in it from its peripheral edge whereby the pad may conform precisely to the working surface of the tool.

* * * * *

UNITED STATES PATENT AND TRADEMARK OFFICE

CERTIFICATE OF CORRECTION

PATENT NO. : 4,274,232

DATED : June 23, 1981

INVENTOR(S) : STEPHEN J. WYLDE

It is certified that error appears in the above—identified patent and that said Letters Patent is hereby corrected as shown below:

In the Claims:

Claim 1, line 11, (Col. 4, line 66) "second relatively soft" should read --relatively soft second--.

Signed and Sealed this

*Twentieth* Day of *October 1981*

[SEAL]

*Attest:*

GERALD J. MOSSINGHOFF

*Attesting Officer*

*Commissioner of Patents and Trademarks*